US005377958A

United States Patent [19]

Palmer

[11] Patent Number: 5,377,958

[45] Date of Patent: Jan. 3, 1995

[54] SAFETY RAILING SYSTEM

[75] Inventor: Theodore R. Palmer, Coquitlam, Canada

[73] Assignee: PRS Industries Inc., Burnaby, Canada

[21] Appl. No.: 891,637

[22] Filed: May 29, 1992

[51] Int. Cl.[6] ..... E04G 3/00; E04H 17/00

[52] U.S. Cl. ..... 256/59; 256/64; 182/113

[58] Field of Search ..... 256/59, DIG. 6, 60, 256/63, 64; 182/113, 45

[56] References Cited

U.S. PATENT DOCUMENTS

| | | | |
|---|---|---|---|
| 1,926,207 | 9/1933 | MacAlpine | 182/113 |
| 3,901,481 | 8/1975 | Probst | 256/59 |
| 4,669,577 | 6/1987 | Werner | 182/113 |
| 4,957,185 | 9/1990 | Courehesne | 182/45 |

FOREIGN PATENT DOCUMENTS

| | | | |
|---|---|---|---|
| 2504348 | 8/1976 | Germany | 182/45 |
| 3214410 | 10/1983 | Germany | 182/45 |
| 8800985 | 11/1989 | Netherlands | 182/45 |

*Primary Examiner*—Randolph A. Reese
*Assistant Examiner*—Anthony Knight
*Attorney, Agent, or Firm*—Todd N. Hathaway

[57] ABSTRACT

A safety railing for installation about a roof edge of a building. Vertically extending stanchion members are mounted to wall brackets by pivoting links. These swing outwardly in response to an impact on the railing at the upper ends of the stanchions, so that a combined pull-out and shear loading is applied to the wall bracket. This effectively increases the load-bearing capacity of the fasteners which attach the bracket to the wall. The swinging link member may be a pivoting hook, and this detachably engages a horizontally-extending pivot pin which is mounted to a middle portion of the stanchion.

16 Claims, 4 Drawing Sheets

SAFETY RAILING SYSTEM

FIELD OF THE INVENTION

The present invention relates generally to safety restraints, and, more particularly, to a safety railing for temporary installation around the edge of a building roof during construction work.

BACKGROUND OF THE INVENTION

A recurring safety problem has been workers falling from the roofs of buildings which are under construction, or on which other work is being performed. Oftentimes, these accidents occur when the workers are moving about and carrying materials back and forth, and it sometimes happens that a worker will simply back over the edge of the roof while not looking.

The magnitude of this hazard has drawn the attention of several regulatory bodies, including the Occupational Safety and Health Administration in the United States, and the Department of Occupational Safety and Health in Canada. As a result, some form of barrier is now required around roof edges where people will be working, and various attempts have been made to comply with this, with very modest success to date. For example, one approach has been to plant a series of posts on the roof and string a cord and warning flags between these; obviously, the actual restraint which is provided by the cord is minimal, and so this must be placed a considerable distance (about 6 feet) inboard from the edge of the roof, which tends to greatly reduce the available working space, and also presents a problem when it becomes necessary to work in the area outside the cord. A somewhat similar approach has involved the use of rails mounted to posts supported by base plates which rest on top of the roof; while this provides a somewhat more positive restraint, the base plates must still be set in a significant distance from the edge of the roof, which restricts the ability of the workers to work near the edge, and this also necessitates a laborious and time consuming effort to move the railings as the work progresses over the surface of the roof.

Attempts have also been made to mount a railing at the very edge of the roof, usually by mounting a plain bracket (such as a conventional leg-and-shield type arrangement) to the outer wall of the building and then mounting the bottom of a stanchion to this so that the stanchion extends up above the edge of the roof and supports railings which are mounted to this. Several problems have been encountered with this approach, and these stem primarily from the inability of this arrangement to withstand any significant loading or impact on the upper railing. Current requirements call for the upper rail to be positioned about 42 inches above the edge of the roof, and OSHA standards require this to be able to withstand the impact of a 200 pound worker, while Canadian standards call for this rail to be able to support a 200 pound static load in either outward or inward directions. When a conventional bracket arrangement is used, these loads translate to a pull-out force on the order of 1000 pounds or more at the wall bracket; for example, if an outwardly directed impact is received by the rail at the upper end of the stanchion, this will tend to force the lower edge of the bracket plate into the wall of the building so that this acts as a pivot point, and this provides a lever arm for pulling out the fasteners which hold the plate to the wall, much in the same manner that a claw hammer provides leverage for removing a nail. Of course, if there is the force at the rail is directed inwardly, the upper edge of the bracket serves as the pivot point, with the same result. Also, because of this pivoting action, essentially the entire pull-out force must be born by whichever fastener is located near the outwardly moving edge of the plate, while the fasteners near the pivot edge bears relatively little of this.

The net result of this situation is that conventional railings of this type are either wholly inadequate in terms of their ability to restrain workers against potential accidents, or they must be constructed so massively as to be very difficult to install and remove, which renders them impractical for many applications. For example, those fasteners which are favored for quick installation and removal from concrete (e.g., those sold under the trade names "Tap-Con" and "Scru-It") simply do not have the load-bearing capacity necessary to withstand the pull-out loads to which they would be subjected in an conventional bracket-mounting arrangement, and so fasteners of a heavier and usually more permanent nature (e.g., lag bolts) must be employed, which simply renders this approach impractical for temporary installations.

Accordingly, there exists a need for a railing system which can be mounted right at the edge of a roof so as to make the maximum space available for work, and also eliminate the need to move this as the work progresses. Furthermore, there exists a need for a railing system of this type which is easily installed and removed, so that this can be efficiently used on a temporary basis during building construction. Still further, there is a need for a railing system of this type which is economical to fabricate, and which takes advantage of readily available railing members, such as standard length 2×4s.

SUMMARY OF THE INVENTION

The present invention has solved the problems cited above, and this is a safety railing for installation about the roof edge of a building, the safety railing comprising vertically elongate stanchion members each having a lower end and an upper end which is configured to extend above the roof edge, the upper end being configured for mounting to a railing member. A bracket member is provided for mounting to an outer wall of the building, and a pivoting link member is provided for interconnecting the bracket member and a middle portion of the stanchion member so that in response to application of an outwardly directed force to the railing member on the upper end of the stanchion, the lower end of the stanchion is pivoted inwardly against the wall of a building, and the pivoting link member is pivoted outwardly at an angle to the bracket member such that the force is transmitted to the bracket member in a combined pull-out and shear direction. The assembly may include a plurality of fasteners for mounting the bracket member to the wall, and for transmitting the force in the combined direction thereto.

Preferably, the safety railing further comprises hinge means for connecting the pivoting link member to the base member so that the link member is pivotable about an axis which extends in a horizontal direction. An attachment member may be mounted to the middle portion of the stanchion member for detachably mounting the stanchion to an outer end of the pivoting link, and this may be a laterally-extending pivot pin. To receive this, the pivoting link member may comprise at least one hook portion which is configured to receive and support the pivot pin so that this pivots about an axis which extends in a horizontal direction, this being parallel to the axis of the hinge on the bracket member.

Preferably, there are first and second stopper assemblies mounted to the stanchion member and extending inwardly from this so as to abut the wall of the building, the first being mounted below the pivot pin and the second being mounted above this. The stopper assemblies are each configured for selective adjustment of the distance which they extend inwardly from a stanchion member, so as to permit adjustment of the stanchion member to a vertical alignment, and also to an outwardly displaced position such that the possibility of accidental dislodgement of the pivot pin from the hook portion of the swinging link as a result of movement of the stanchion member is eliminated.

At the upper end of the stanchion member, there may be a loop member which is configured to receive the overlapped ends of first and second railing members. These railing members may be wooden boards, and the loop member may be provided with an opening for extending a nail through the loop member and into the overlapped ends of the wooden rail member so as to lock these together within the loop member.

Objects and advantages of the invention not clear from the above will be understood by a reading of the detailed description and a review of the accompanying drawings.

DETAILED DESCRIPTION

Figure 1:
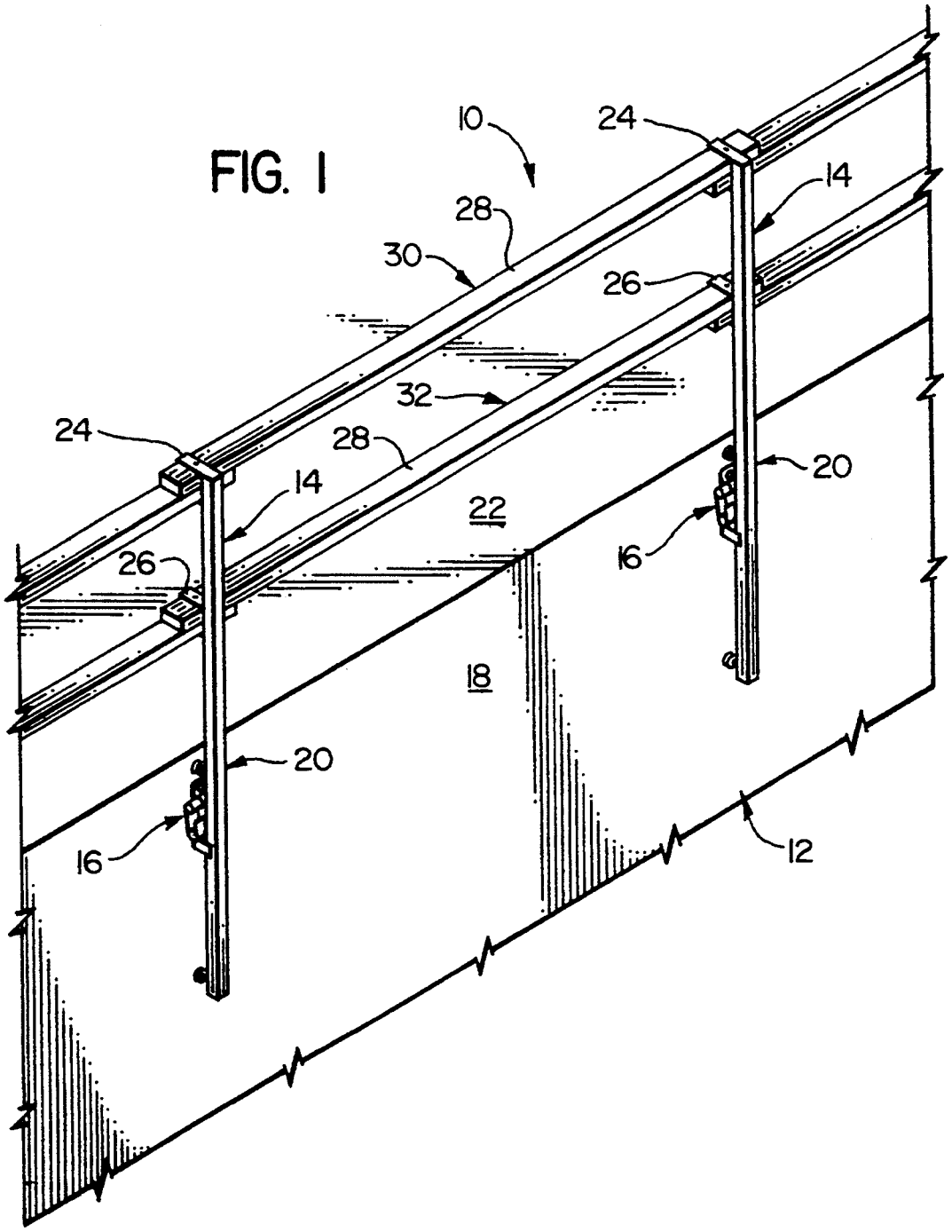
FIG. 1 is a perspective view of the railing system of the present invention, this showing the system mounted at the roof edge of a building, with 2×4 railing members extending between the stanchions.

FIG. 1 provides an overview of the railing system 10, this being mounted to the roof edge of a building 12. The railing system comprises a series of spaced-apart support assemblies 14, each of these being made up of a swinging link bracket assembly 16 which is mounted to the vertical outer wall 18, and a stanchion assembly 20 which is mounted to the bracket assembly and extends upwardly from this above the edge of the roof 22. At the upper end of each stanchion assembly there is a square loop portion 24, and there is a second square loop portion 26 positioned a short distance down the stanchion below this. These square loop portions provide receptacles through which the ends of rail members 28 extend; as can be seen in FIG. 1, the end of a first rail member is received in each loop portion, and then the end of the next rail member in the series is also received in this loop so as to overlap against the end of the first member. Thus, those rail members which are received and supported in the upper loop portions 24 form a continuous upper rail 30, while those which are received in the lower loop portions 26 form a continuous lower rail 32. It has been found that standard 10-foot long wooden 2×4s provide eminently suitable rail members for this system, and are well up to bearing the necessary impact loads.

Having provided an overview of the railing system of the present invention, its components and their operation will now be described in greater detail.

Figure 2:
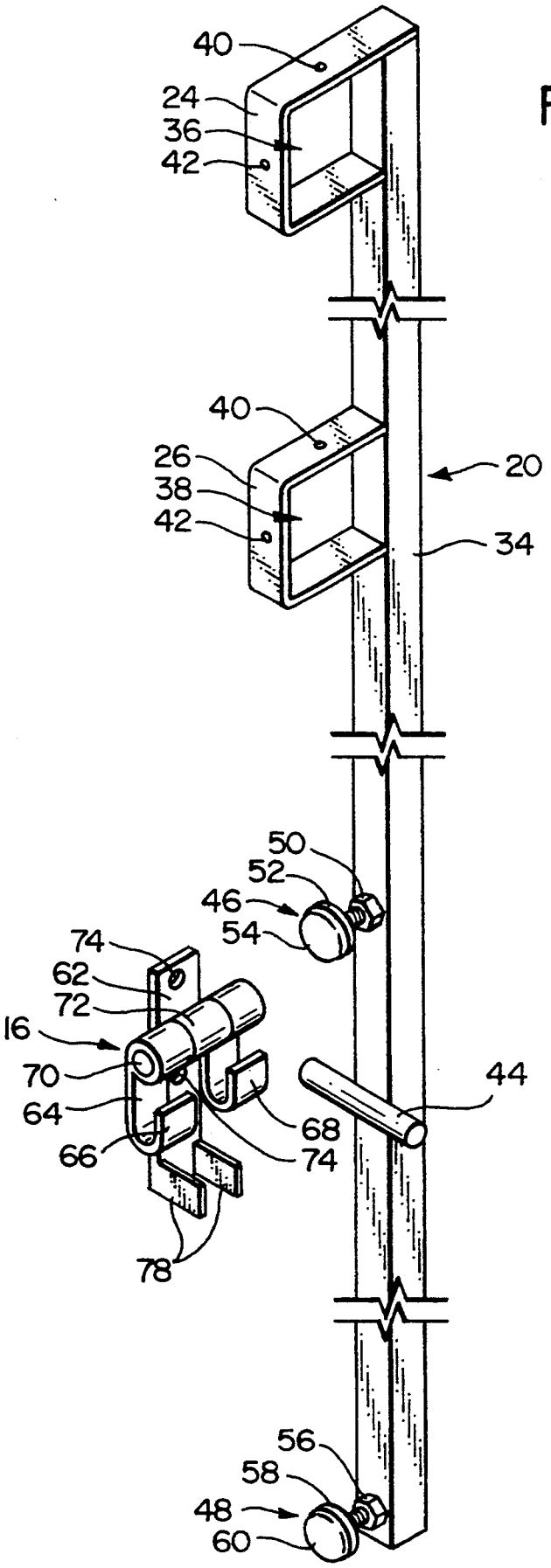
FIG. 2 is a perspective view of the stanchion and mounting bracket assemblies of the railing system of FIG. 1.

FIG. 2 illustrates the two primary support components of the system, the stanchion assembly 20 and the swinging link bracket assembly 16. The primary structural component of the stanchion assembly 20 is an elongate bar member 34, this preferably being a tubular steel member; a 6-foot length of 1¼ inch square steel tubing has been found eminently suitable for this purpose. As was noted above, an upper loop portion 24 is mounted at the upper end of the stanchion, and a lower loop portion 26 is mounted a short way below this. Each of these loop portions is preferably formed of a piece of flat bar stock bent to form a square receiving area 36, 38, and welded to the bar member 34 at the desired locations; it has been found desirable to position the lower loop portion (and hence the lower rail) about 19 inches below the upper.

Each of the square receiving areas 36, 38 is sized so that the ends of two rail members can be received in this, either in side-by-side relationship or overlapped on top of one another: for conventional 2×4s, 3 ¾ inch square receiving areas have been found appropriate. The upper and side legs of each of these square loop portions are pierced by upper and side nail openings 40, 42, the use of which will be discussed below.

Then, generally toward the lower end of the stanchion, there is a pivot pin 44 which is mounted to the bar member 34 so as to extend transversely across this. In order to obtain the desired height of the upper rail above the roof edge (i.e., about 42 inches), it has been found desirable for many applications to mount the pivot pin 44 about 50½ inches below the upper end of a 72-inch stanchion. The pivot pin may be provided by a ½-inch steel pin approximately 4 inches long, and this is preferably mounted to the same, inboard face of the square bar member 34 as the loop portions, so that the rail members are supported against the inboard side of the bar member (i.e., toward the working area) when the assembly is in place.

A first adjustable stopper assembly 46 is mounted a relatively short distance (e.g., about 6 inches) above the horizontally extending pivot pin, and this is made up of a base nut 50 which is welded to the inboard face of the bar member, and a foot portion 52 having a threaded shaft which is engaged by the base nut so that the distance by which the foot portion extends inwardly from the bar member 34 is selectively adjustable. A hole (not shown) is formed in the inboard wall of bar member 34 for the shaft of the foot portion to extend through in order to permit a greater range of adjustment, and an elastomeric friction pad 54 is mounted on the outer end of the foot portion so as to enhance the frictional engagement of the stopper assembly with the outer wall of the building. The lower stopper assembly 48, in turn, is mounted at or near the very lower end of bar member 34 (about 21–22 inches below pivot pin 44 on a 6-foot long stanchion assembly), and this similarly comprises a base nut 56, adjustable foot portion 58, and friction pad 60. As will become apparent from the description provided below, these stopper assemblies serve to provide the correct vertical alignment of the stanchion assembly, and also make it impossible for this to be accidentally dislodged from the bracket assembly once the system has been properly installed and adjusted.

Turning now to the bracket assembly 16, it will be seen in FIG. 2 that this comprises generally a base plate portion 62 and a swinging link portion 64. The swinging link portion is made up of first and second parallel hook portions 66, 68, these having U-shaped enclosed ends which together define an area for receiving the pivot pin 44 of the stanchion assembly, and supporting this in pivoting relationship; hook portions providing a receiving channel about 2 inches long and about ⅜ inch wide have been found suitable for use with a stanchion assembly having the exemplary dimensions described above. The two hook portions 66, 68 are interconnected by the pin of a hinge 70 so that these move together in unison. The central loop 72 of the hinge, in turn, is mounted to the base plate portion of the assembly. This base plate portion is a flat, preferably rectangular member which is configured to abut the outer wall of the building. This is pierced by bores 74 above and below the hinge loop for the fasteners to extend through. A suitable spacing for these fastener bores has been found to be about 3 inches, centered on the horizontal hinge of the assembly, with a lower portion of the base plate extending about 3½ inches below the lower bore to give an overall plate length of about 7 inches. First and second upstanding, parallel ears 78 are mounted at the lower end of the base plate, and these define a gap for receiving the bar member 34 of the stanchion assembly and fitting closely adjacent the sidewalls of this; these ears 78 serve to steady the stanchion assemblies against side-to-side "tipping" motion before the rail members have been installed therein.

Figure 3:
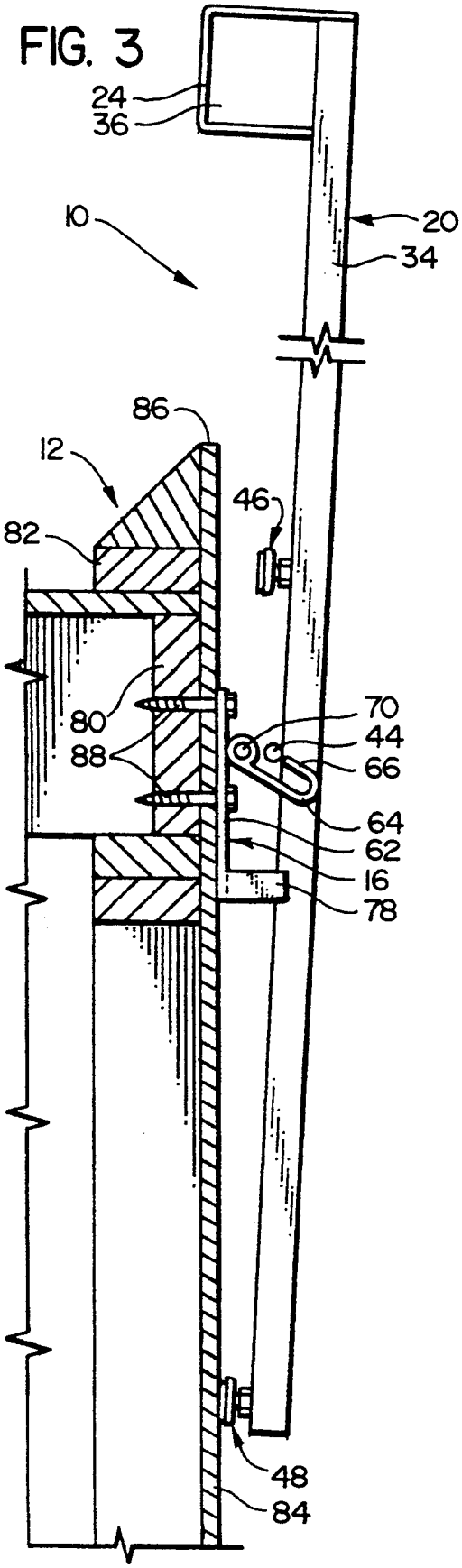
FIG. 3 is a side elevational view of a portion of the railing system of FIG. 1, showing this being installed on the roof edge of the building, the building being shown partly in cross section.

The installation of these assemblies and their adjustment will now be described with reference to FIGS. 3–4. The building structure 12 shown in FIG. 3 represents a typical wooden construction, in which there are wooden wall studs 80, 82 covered by an exterior facia 84, and these provide anchors for the fasteners of the railing system 10. However, it will be understood that the mounting shown here is equally applicable to concrete block structures, in which there is a concrete bond beam at the upper edge of the wall, as well as to those buildings which are constructed with a poured wall which extends all the way to the roof edge.

To install the railing system, the bracket assembly 16 is positioned a sufficient distance below the upper edge 86 of the exterior facia that the upper stopper assembly 46 will be positioned to abut the facia when the stanchion is received in the bracket assembly. The fastener bores are placed in proper vertical alignment, and then fasteners 88 are driven through these into the underlying wall structure. Since the configuration of the railing system of the present invention is such that the fasteners do not have to resist the tremendous pull-out forces which are experienced when using the conventional railing systems discussed above, these can be fasteners of the type which are easily and quickly installed and then removed to provide a temporary installation, such as the Tap-Con TM or Scru-It TM fasteners noted above.

The bracket assembly having been installed, the next step is to set the stanchion assembly in this. This is done by pivoting the swinging link portion 64 of the bracket assembly outwardly so that the gap between the tips of the hook portions 66, 68 and the hinge 70 extends laterally to receive the pivot pin on the stanchion assembly. As may be seen in FIG. 3, the hook portions of the bracket assembly are preferably sized so that this gap is only just large enough to let the pivot pin 44 pass through, so as to further reduce the chances of accidental dislodgment of the stanchion from the bracket assembly.

As the pivot pin is set in the hook portion of the bracket assembly, the lower portion of the bar member 34 is simultaneously received in the gap between the upstanding ear portions 78 these steady the stanchion assembly against side-to-side rocking. The stanchion assembly is then lowered until the pivot pin rests in the closed ends of the hooks 66, 68 and the stanchion is suspended therein, and the foot portions of the stopper assemblies 46, 48 are extended outwardly from bar member 34 until the stanchion is aligned in a vertical direction. Further outward adjustment of the stopper assemblies is made, if necessary, until the pivot pin 44 has pulled the swinging link portion of the bracket assembly outwardly a short distance to the point where the receiving areas in the hook portions no longer extend in a vertical direction, as this is shown in FIG. 4. It will be understood that in this position it is no longer possible for the pivot pin 44 to become accidentally dislodged from the hook portions of the bracket assembly, whether by lifting or pivoting of the stanchion assembly, being that it is not possible to move the pin in a vertical direction within the receiving areas of the hooks.

Figure 4:
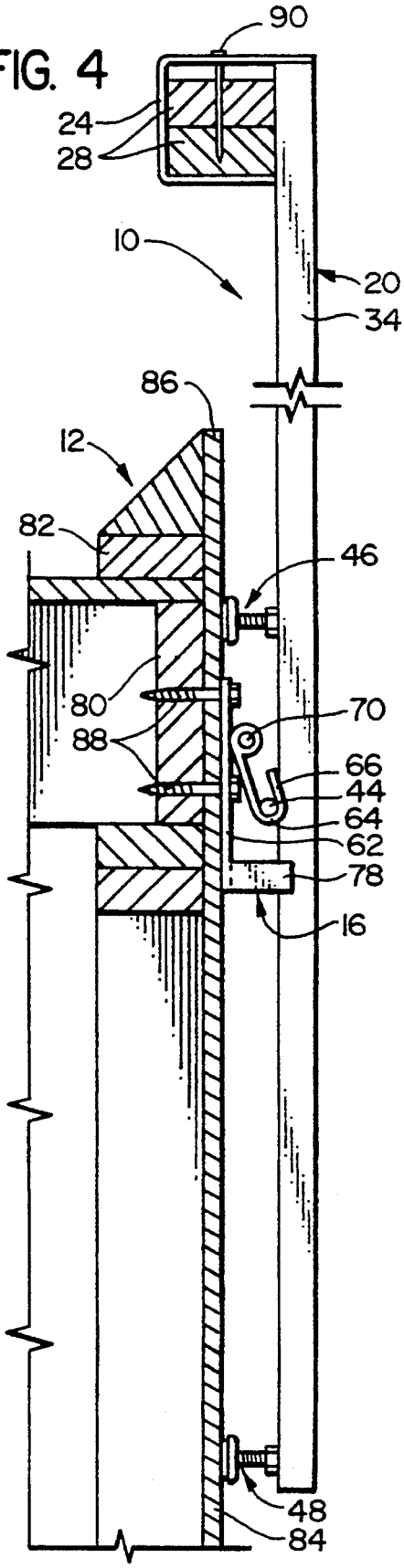
FIG. 4 is a side elevational view similar to that of FIG. 3, showing the railing system having been installed and properly adjusted.

Having completed the installation and alignment of the bracket and stanchion assemblies, the next step is to install the rail members 28, and this is done by inserting their ends in the receiving areas of the loop portions 24, 26 (24 only shown in FIGS. 3–4). These are overlapped in the manner previously described, and a suitable nail 90 is then inserted through the appropriate nail opening (top opening 40, in the arrangement shown in FIG. 4) and hammered into the overlapped ends of the rail members so as to lock these together and prevent them from sliding out of the loop portion. This is done at each of the spaced-apart support assemblies until the continuous rail is completed, and the same is done for the lower rail as well. The installation is then complete and ready for work to commence.

Figure 5:
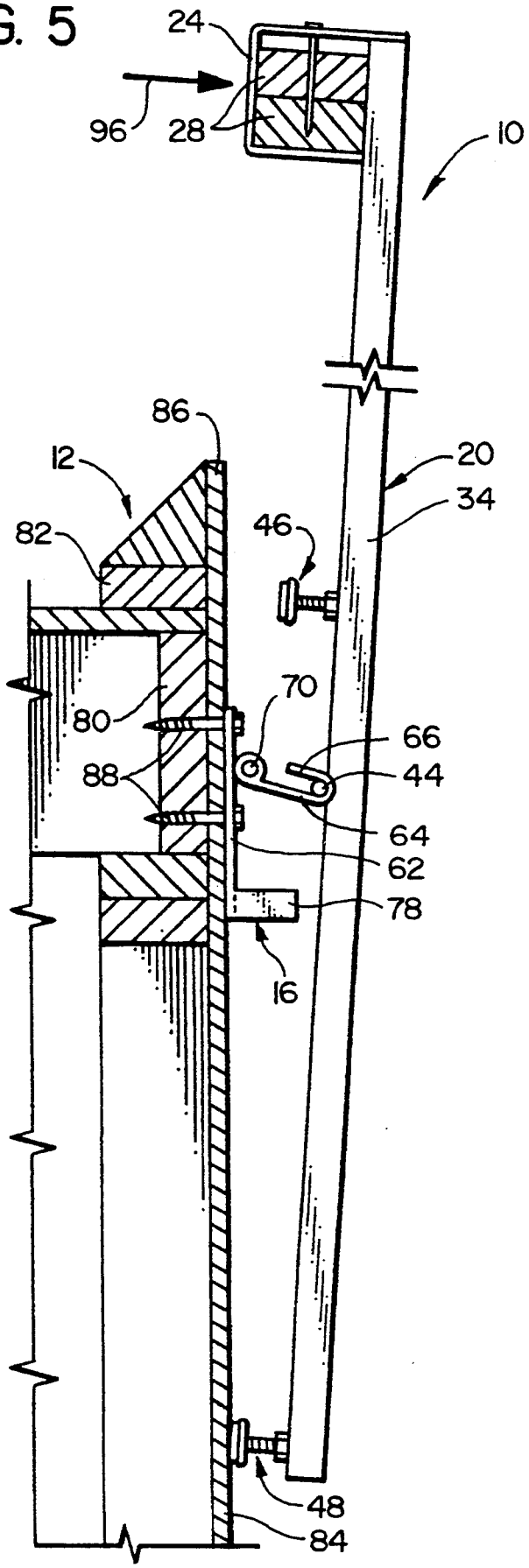
FIG. 5 is a side elevational view similar to that of FIGS. 3–4, showing an outwardly directed force being applied to the upper railing of the system, and how the system responds by the swinging link pivoting outwardly from the wall bracket so that a combined loading is applied to the fasteners which hold this to the building.

FIG. 5 illustrates the operation of the railing system 10, as this would prevent a person from moving outwardly over the edge of the roof. As can be seen, the force of the outwardly directed load or impact is represented in FIG. 5 by arrow 96. As this is applied to the upper railing, this force is transmitted through the railing to the upper end of the bar member 34. This outward movement of the upper end of the bar member causes the stanchion assembly to pivot about pivot pin 44, forcing the lower stopper assembly 48 against the exterior facia 84, and lifting the upper stopper assembly 46 away from this. Simultaneously, as the bar member 34 pivots outwardly about the pivot point which is provided by the lower stopper assembly 48, pivot pin 44 pulls outwardly on the swinging link portion of the bracket assembly, causing the hook portions thereof to pivot outwardly.

In this position, with the hook portions of the bracket assembly extending at an angle from the base plate, and the outward force being transmitted from the stanchion assembly to the bracket assembly in this direction, the fasteners 88 are subjected to a "combined" loading. That is, they are not subjected to a pure pull-out force, nor to a pure shear force, but instead they are subjected to a force which combines elements of both pull-out and shear. As a result, because the fasteners' capacity with respect to both of these forces is being employed, the effective load-bearing ability of each fastener is greatly increased (relative to that for pure pull-out or shear), to the point of being nearly doubled. Also, because the pivot point is now provided by the lower stopper assembly 48, instead of the lower edge of the bracket plate, the ratio of the two lever arms is greatly reduced, and the magnitude of the pull-out force is therefore much smaller. Furthermore, because the force is transmitted to the base plate of the bracket assembly at the midpoint between the two fasteners 88, the load is equally shared by these, rather than one or the other of the fasteners having to bear most of this alone. As was noted above, these factors render the mounting of the railing system of the present invention much safer and more secure than conventional railing systems, and also make it possible to use easily installed temporary fasteners which would not be able to withstand the severe loading which would be encountered when using a conventional bracket arrangement.

Figure 6:
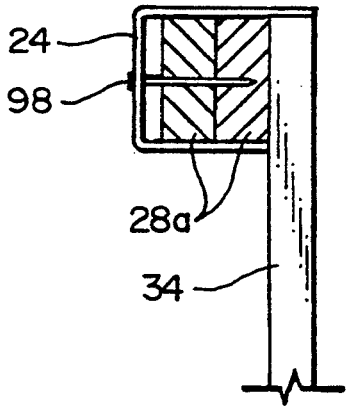
FIG. 6 is a side elevational view of the upper end portion of the stanchion assembly shown above, this showing the ends of 2×4 railing members positioned in this in side-by-side relationship, as opposed to being overlapped on top of one another as shown in FIGS. 4–5.

As was also noted above, the loop portions 24, 26 of the stanchion assemblies are configured so that their receiving areas are able to accommodate the ends of railing members (such as 2×4s) which are laid on top of one another, so that the railing members themselves rest horizontally, or these ends may be positioned in side-by-side relationship so that the railing members stand on edge. FIG. 6 shows this latter arrangement, with the two railing members 28*a* set on edge in the loop portion 24, and then a nail 98 is inserted through the side nail opening and driven into the boards to hold these in place.

Having described the invention in its preferred embodiments, it will be clear that changes and modifications may be made without departing from the spirit of the invention. It is therefore not intended that the words used to describe the invention or the drawings illustrating the same be limiting on the invention. Rather, it is intended that the invention only be limited by the scope of the appended claims.

What is claimed is:

1. A safety railing for installation about a roof edge of a building, said safety railing comprising:

a vertically elongate stanchion member having an upper end configured to extend above said roof edge and a lower end, said upper end of said stanchion member being configured for mounting to a railing member;

a bracket member configured for mounting to a vertical outer surface of a wall of said building, said bracket member comprising:

a plate member configured to lie flat against said vertical outer surface of said wall, and fastening means extending perpendiuclarly from said plate member to said vertical surface of said wall so as to mount said bracket member thereto, said fastening means having a predetermined resistance to a force in a combined pull-out and shear direction which is greater than a resistance of said fasteneing means to forces in either pure pull-out or pure shear directions;

a pivoting link member for interconnecting said bracket member and a middle portion of said stanchion member; and upper and lower stopper assemblies mounted, respectively, above and below said pivoting link member so that said pivoting link member is vertically flanked by said stopper assemblies, each said stopper assembly extending inwardly from said stanchion member so as to abut said wall of said building;

so that in response to application of outwardly-directed and inwardly-directed loading to a said railing member mounted to said upper end of said stanchion member, said lower and upper stopper assemblies, respectively, are forced inwardly against said wall of said building, and said pivoting link member swings outwardly to an acute angle to said vertical wall surface such that said loading is transmitted through said link member to said bracket member in said combined pull-out and shear direction to which said fastening means has said predetermined resistance which is greater than said resistance to forces in said pure shear or pull-out directions.

2. The safety railing of claim 1, further comprising a plurality of fasteners for mounting said bracket member to said wall and transmitting said force in said combined direction thereto.

3. The safety railing of claim 2, further comprising hinge means connecting said pivoting link member to said bracket member eo that said link member is pivotable about an axis which extends in a horizontal direction.

4. The safety railing of claim 3, further comprising second hinge means for connecting said middle portion of said stanchion member to an outer end of said pivoting link member.

5. The safety railing of claim 4, wherein said second hinge means comprises a pivot pin mounted to said stanchion member so as to extend laterally thereto.

6. The safety railing of claim 4, wherein said outer end of said pivoting link member comprises at least one hook portion configured to receive and support said pivot pin so as to permit said pivot pin to pivot about an axis which extends in a horizontal direction parallel to said axis of said hinge means on said bracket member.

7. The safety railing of claim 6, wherein said bracket member further comprises first and second ear portions extending outwardly from said bracket member so as to define a gap for receiving a portion of said stanchion member below said pivot pin when said pivot pin is received in said hook portion, so that said ear portions are positioned closely adjacent sides of said stanchion member so as to stabilize said stanchion member against side-to-side tilting.

8. The safety railing of claim 4, further comprising a loop member mounted to said upper end of said stanchion member, said loop member being configured to receive overlapped ends of first and second said railing members.

9. The safety railing of claim 8, wherein said railing members are wooden boards, and said loop member is provided with an opening for extending a nail through said loop member and into said overlapped ends of said wooden rail members so as to lock said ends of said rail members together in said loop member.

10. The safety railing of claim 1, wherein said fastening means comprises:

at least one screw fastener which extends in a generally horizontal direction through said plate member and into said wall of said building.

11. The safety railing of claim 9, wherein said at least one screw fastener comprises:

a plurality of lag bolts which extend horizontally into said wall and engage the material thereof so that each said bolt has a resistance to a force in a combined pull-out and shear direction which is greater than a resistance of said bolt to forces in either pure pull-out or pure shear directions.

12. A safety railing for installation about a roof edge of a building, said safety railing comprising:

a vertically elongate stanchion member having an upper end configured to extend above said roof edge and a lower end, said upper end of said stanchion member being configured for mounting to a railing member which extends along and above said roof edge;

a bracket member configured for mounting to an outer wall of said building;

a pivoting link member for interconnecting said bracket member and a middle portion of said stanchion member, so that in response to application of an outwardly-directed force to a said railing member mounted to said upper end of said stanchion member, said lower end of said stanchion member pivots inwardly against said wall of said building and said pivoting link member pivots outwardly at an angle to said bracket member such that said force is transmitted to said bracket member in a combined pull-out and shear direction;

first hinge means for connecting said pivoting link member to said base member so that said link member is pivotable about an axis which extends in a horizontal direction; and second hinge means for connecting said middle portion of said stanchion member to an outer end of said pivoting link member so as to permit said stanchion member to pivot about an axis which extends in a horizontal direction parallel to said axis of said first hinge means on said bracket member;

said bracket member further comprising first and second ear portions extending outwardly from said bracket member so as to define a gap for receiving a portion of said stanchion member below said pivot pin when said pivot pin is received in said hook portion, so that said ear portions are positioned closely adjacent sides of said stanchion member so as to stabilize said stanchion member against side-to-side tilting.

13. A safety railing for installation about a roof edge of a building, said safety railing comprising:

a vertically elongate stanchion member having an upper end configured to extend above said roof edqe and a lower end, said upper end of said stanchion member being configured for mounting to a railing member;

a pivot pin member mounted to a middle portion of said stanchion member so as to extend transversely thereto in a horizontal direction;

a bracket member configured for mounting to a vertical outer surface of a wall of said building;

means for fastening said bracket member to said outer surface of said wall;

a pivoting hook member for interconnecting said bracket member and said middle portion of said stanchion member, said hook member comprising:

an opening formed at an upper end of said hook member for receiving said pivot pin member, a hinge portion pivotally mounting said upper end of said hook member to said bracket member, and a U-shaped closed lower end defining a vertically elongate channel for retaining said pin member in pivoting relationship therewith;

upper and lower stopper assemblies mounted, respectively, above and below said pivot pin member so that said pin member and said hook member are vertically flanked by said stopper assemblies, each said stopper assembly being configured to extend inwardly from said stanchion member by a selectively adjustable distance so as to abut said vertical surface of said wall;

so that in response to application of outwardly-directed and inwardly-directed loading to a said railing member mounted to said upper end of said stanchion member, said lower and upper stopper assemblies, respectively, are forced inwardly against said wall of said building, and said pivoting hook member swings outwardly to an acute angle to said vertical wall surface such that said loading is transmitted through said hook member to said bracket member in a combined pull-out and shear direction; and so that in response to selective adjustment of said distances by which said stopper assemblies extend inwardly from said stanchion member against said wall, said lower end of said hook member in which said pin member is retained pivots around said hinge portion and outwardly from said wall to a position in which said elongate channel no longer extends in a vertical direction, so as to prevent vertical movement and dislodgment of said pin member through said channel and opening of said hook member.

14. The safety railing of claim 13 wherein said bracket member comprises:

a generally planar plate member which is configured to lie flat against said vertical outer surface of said wall.

15. The safety railing of claim 14 further comprising:

fastening means extending perpendicularly from said plate member to said vertical surface of said wall so as to mount said bracket member thereto;

said fastening means having a predetermined resistance to a force in said combined pull-out and shear direction which is greater than a resistances of said fastening means to forces in pure pull-out and pure shear directions.

16. The safety railing of claim 15, wherein said fastening means comprises:

at least one screw fastener which extends in a generally horizontal direction through said plate member and into said wall of said building.

* * * * *